United States Patent [19]

Rascov

[11] Patent Number: 4,788,944

[45] Date of Patent: Dec. 6, 1988

[54] INTERNAL COMBUSTION ENGINE

[76] Inventor: Anthony J. Rascov, 4303 Tobasco Rd., Cincinnati, Ohio 45244

[21] Appl. No.: 64,955

[22] Filed: Jun. 22, 1987

[51] Int. Cl.[4] ..... F02B 75/24

[52] U.S. Cl. ..... 123/56 AC; 123/56 BC; 123/47 R; 123/197 AC

[58] Field of Search ..... 123/55 R, 56 AC, 56 BC, 123/197 R, 47 R, 71 R

[56] References Cited

U.S. PATENT DOCUMENTS

| | | | |
|---|---|---|---|
| 692,625 | 2/1902 | Clark | 123/56 AC |
| 1,171,620 | 2/1916 | McIntyre | 123/56 AC |
| 1,355,348 | 10/1920 | Mott | 123/47 R |
| 1,841,021 | 1/1932 | Everts | 123/56 AC |
| 3,258,992 | 7/1966 | Hittell | 123/55 R |
| 3,584,610 | 6/1971 | Porter | 123/47 R |
| 3,606,870 | 9/1971 | Llewellyn | 123/55 R |
| 4,138,972 | 2/1979 | Wilson | 123/71 R |
| 4,250,844 | 2/1981 | Tews | 123/73 R |
| 4,261,303 | 4/1981 | Ramsey | 123/47 R |

*Primary Examiner*—Charles J. Myhre
*Assistant Examiner*—David A. Okonsky
*Attorney, Agent, or Firm*—Frost & Jacobs

[57] ABSTRACT

An internal combustion engine includes a housing having a first cylinder chamber and a second cylinder chamber, wherein the cylinder chambers are perpendicular to each other. Each cylinder chamber includes a reciprocating piston assembly having a compression piston head and a combustion piston head connected by a hollow tube. A crankshaft is rotatably connected to each piston assembly and to a power transfer assembly. The power transfer assembly transfers rotary motion of the crankshaft to an output shaft.

11 Claims, 4 Drawing Sheets

INTERNAL COMBUSTION ENGINE

BACKGROUND OF THE INVENTION

1. Field of the Invention

The present invention is an internal combustion engine, and in particular, discloses an engine having a pair of piston assemblies that are perpendicular with one another, and which drive a common crankshaft to provide a power source.

It will be understood that the engine construction disclosed herein can be modified to act as a compressor. As a compressor, the perpendicular cylinder chambers and piston assemblies and their relationship with a crankshaft would be substantially the same. Modifications known in the compressor art can be made so that the compressor acts as a selected multi-stage compressor. For purposes of clarity, the following description is directed to an internal combustion engine only.

2. Description of the Related Art

Traditional internal combustion engine layouts include reciprocating pistons in cylinder chambers. Generally, a plurality of pistons (oftentimes 2, 4, 6 or 8) are aligned in various configurations in a block. The reciprocating motion of the pistons is transmitted through a crankshaft to a selected output shaft. The output shaft is connected to a load, such as an axle in an automobile.

SUMMARY OF THE INVENTION

The present invention includes an internal combustion engine which requires a minimum amount of lubrication and has a reduced operating temperature. High temperature cylinders can be utilized with the present engine, thereby eliminating pollutants in the exhaust gases.

In a first preferred embodiment, an internal combustion engine includes a housing having a first cylinder chamber and a second cylinder chamber, wherein the longitudinal axis of each chamber is perpendicular to the other. Each cylinder chamber includes a reciprocating piston assembly having a compression piston head and a combustion piston head connected by a hollow tube. A crankshaft is rotatably connected to each piston assembly and to a power transfer assembly. The power transfer assembly includes a tangent bar connected to the crankshaft by rollers. A flywheel is connected to the tangent bar and an output shaft. As the piston assemblies reciprocate in their respective chambers, the crankshaft is rotated to drive the output shaft.

In an alternate embodiment, a compressed air/fuel mixture is supplied to the engine. Each piston of the first and second piston assemblies acts as a combustor piston, thereby producing a four combustor engine.

BRIEF DESCRIPTION OF THE DRAWINGS

Other features and advantages of the present invention will become more fully apparent from the following detailed description of the preferred embodiment, the appended claims, and the accompanying drawings in which:

Reference will now be made in detail to the present preferred embodiment of the invention, an example of which is illustrated in the accompanying drawings.

DETAILED DESCRIPTION OF THE PREFERRED EMBODIMENT

Figure 1:
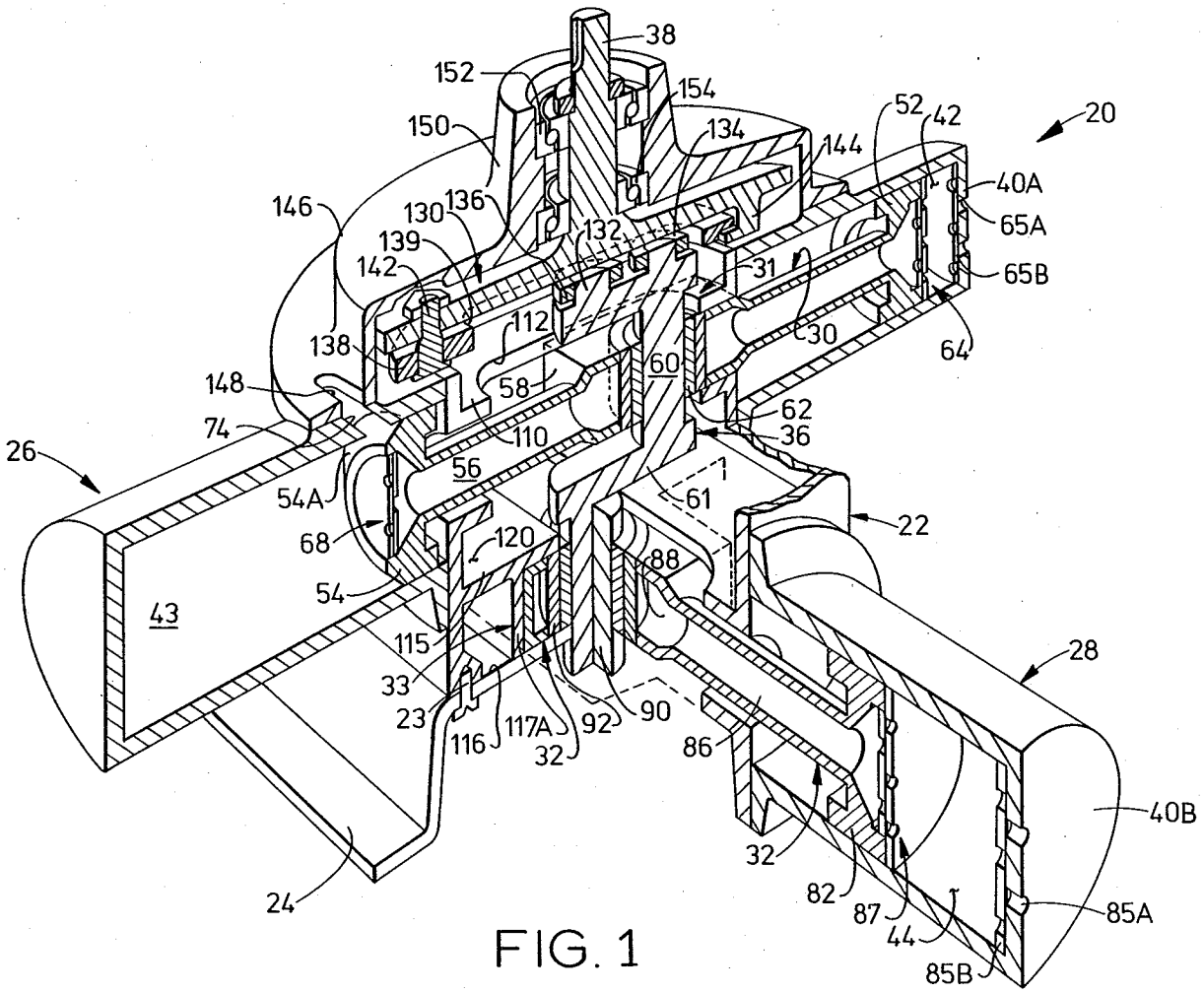
FIG. 1 is a perspective, sectional view of a first preferred embodiment of the present engine.
Figure 2:
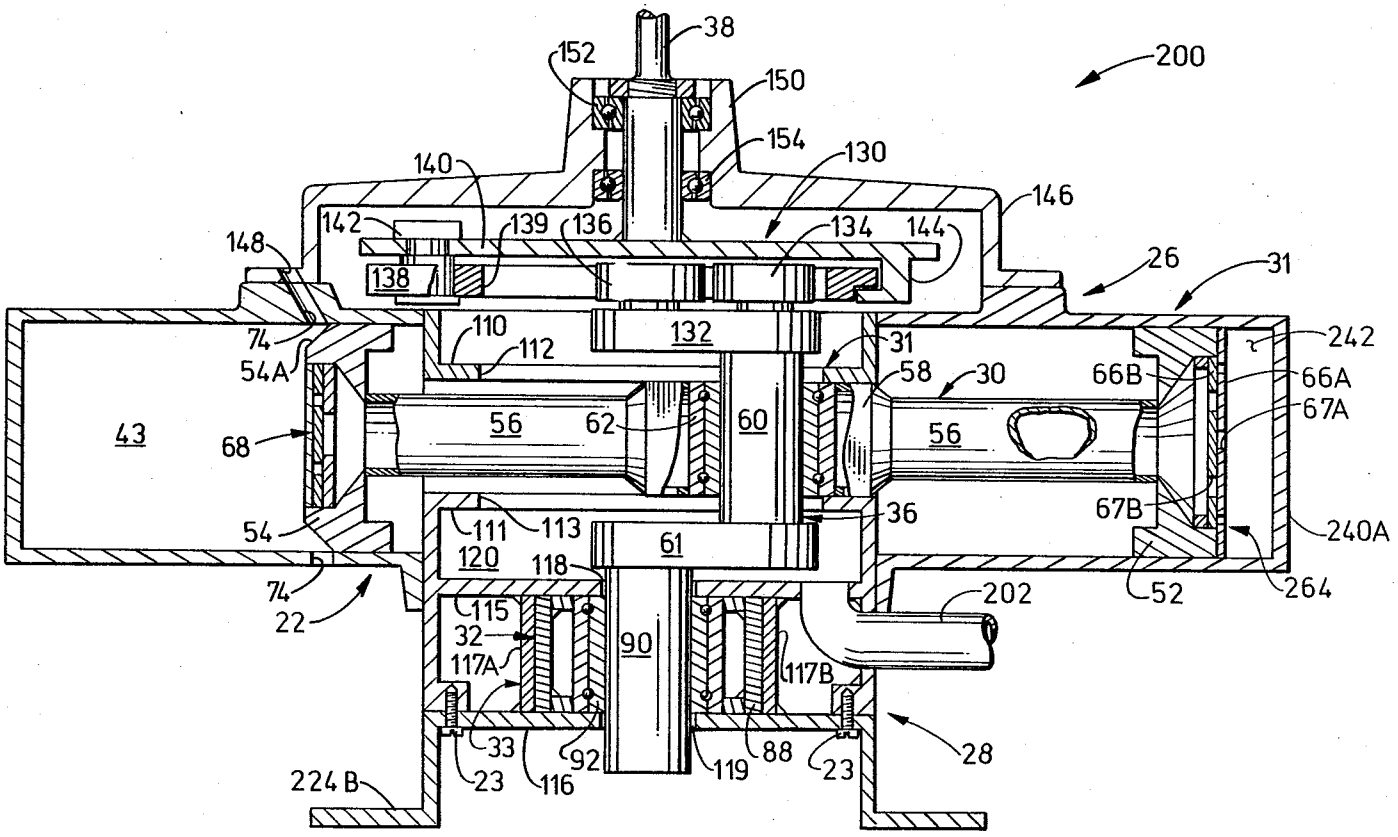
FIG. 2 is a sectional view of a second preferred embodiment of the present engine.

A first preferred embodiment of an internal combustion engine of the present invention, indicated generally at 20, is illustrated in FIG. 1. A second preferred embodiment of the present engine, indicated generally at 200, is illustrated in FIG. 2. Engine 20 operates as a two combustion engine, while engine 200 operates as a four combustor internal combustion engine, meaning that all four pistons combust in the respective cylinder chambers. Throughout the description and drawings, like elements to both engines 20 and 200 are indicated with the same reference numerals. Elements common to both engines 20 and 200 are indicated with reference numerals less than 200, while elements incorporated only in engine 200 are indicated with reference numerals greater than 200.

Engine 20 includes a central housing 22 which is held upright by supports 24. The housing 22 houses the moving parts of the engine 20 and can be constructed of any durable material. The supports 24 may be connected to the housing 22 in any conventional manner, e.g. by fasteners 23 as illustrated in FIG. 1, welding, etc.

The housing 22 includes a pair of cylinder chambers, indicated generally at 26 and 28, which are oriented so that the longitudinal axis of each chamber is perpendicular to the other. Cylinder chamber 26 includes a reciprocating piston assembly 30. Cylinder chamber 28 includes a reciprocating piston assembly 32.

Piston assemblies 30 and 32 drive crankshaft 36. Crankshaft 36 is connected to output shaft 38 to provide a source of rotary energy which can be utilized in any conventional manner.

The central housing 22 includes an upper piston chamber 31 formed by a top plate 110, a bottom plate 111 and connecting side walls (not illustrated). The longitudinal axis of piston chamber 31 is colinear with the longitudinal axis of the upper cylinder chamber 26. It is preferred that the cross section of the piston chamber 31 be rectangular, as is explained below. Both the top plate 110 and the bottom plate 111 include elongated slots 112 and 113, respectively, provided in their respective central portions.

In a similar manner, a lower piston chamber 33 is provided in the central housing 22 beneath the upper piston chamber 31. The lower piston chamber 33 is positioned so that its longitudinal axis is perpendicular to the longitudinal axis of the upper piston chamber 31 and colinear with the longitudinal axis of the lower cylinder chamber 28. The lower piston chamber 33 is formed by a top plate 115, a bottom plate 116, and connecting side walls 117A and 117B, and has a rectangular cross section. Elongated slots 118 and 119 are provided in the central portions of the top plate 115 and the bottom plate 116, respectively. An internal pressurized chamber 120 is formed between the upper and lower piston chambers 31 and 33. Chamber 120 is bounded by bottom plate 111, top plate 115 and the central housing 22.

Cylinder chamber 26 is divided into a compression chamber 42 and a combustion chamber 43. The compression chamber 42 and the combustion chamber 43 are connected by the upper piston chamber 31. Cylinder chamber 28 is divided into a compression chamber 44 and a combustion chamber 45. Chambers 44 and 45 are connected by the lower piston chamber 33.

Piston assembly 30 reciprocates in cylinder chamber 26 and the upper piston chamber 31. Piston assembly 30 includes a first or compression piston head 52 and a second or combustion piston head 54. The piston heads 52 and 54 are connected by a hollow tube 56 which has a hollow central portion 58. It is preferred that the central portion 58 have a rectangular cross section complementary to the cross section of the upper piston chamber 31. The longitudinal axis of the central portion 58 and tube 56 is colinear with the longitudinal axis of cylinder chamber 26.

A first crankpin 60 of crankshaft 36 is received in the central portion 58 of tube 56 so that the longitudinal axis of crankpin 60 is perpendicular to the longitudinal axis of the central portion 58. A bearing 62 is provided between crankpin 60 and central portion 58. Crankpin 60 rotates within bearing 62 as piston assembly 30 reciprocates in the cylinder chamber 26 and upper piston chamber 31. Air and gas pass through the central portion 58 around bearing 62 during operation of the engine 20.

Figure 3:
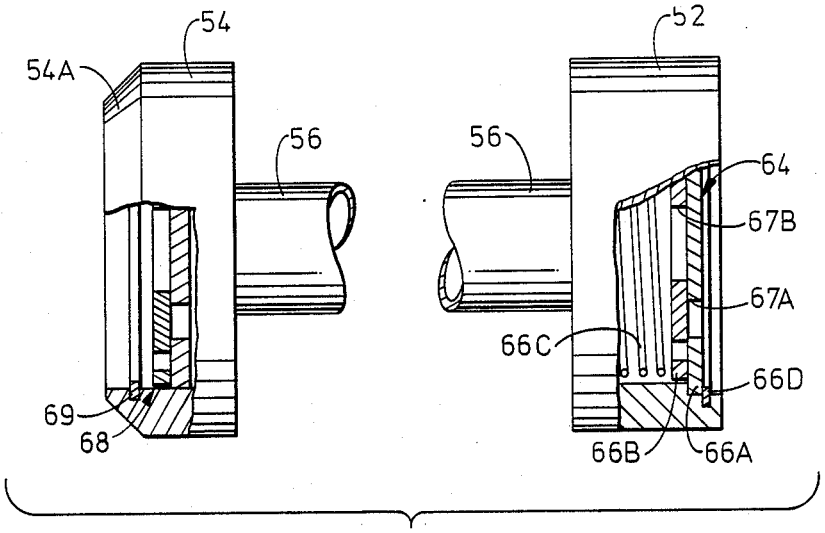
FIG. 3 is a fragmentary, partially-sectional view of a piston assembly incorporated in the engine of FIG. 1.

An intake air/fuel mixture is drawn through air inlets 65A and washer valve 65B in the endwall 40A into the compression chamber 42. As the piston assembly 30 reciprocates to the right in FIGS. 1 and 2, air is forced through a washer valve assembly 64 into the compression piston head 52. As illustrated best in FIG. 3, the washer valve assembly 64 includes a pair of baffle plates 66A and 66B held in a closed position by spring 66C and 66D C-ring or retaining ring. The baffle plates 66A and 66B are oriented so that the respective ports 67A and 67B do not align. As the air/fuel mixture enters piston head 52 from the combustion chamber 42, the mixture forces baffle plate 66B away from baffle plate 66A so that the mixture passes from ports 67A to ports 67B to the tubular portion 56 of the piston assembly 30. Air travels through the central portion 58 to the opposite tube portion 56 and exits through a washer valve assembly 68 press fitted in the assembly 30. Gases exiting from the compression piston head 54 enter the combustion chamber 43 where conventional combustion occurs.

It is preferred that the combustion piston head 54 be beveled near its end portion 54A. Exhaust ports 74 are provided in the cylinder chamber 26 for the release of spent gases in the combustion chamber 43. If desired, an exhaust pipe and muffler (not illustrated) can be connected to the exhaust ports 74 for carrying away exhaust gas from the combustion chamber 43.

Piston assembly 32 reciprocates in cylinder chamber 28 and the lower piston chamber 33. Piston assembly 32 is identical in construction to piston assembly 30 and includes a compression piston head 82, a combustion head 84, a hollow tube 86 and a hollow central portion 88. The cross section of central portion 88 is complementary to the cross section of the lower piston chamber 33. The longitudinal axis of the central portion 88 and tube 86 are colinear with the longitudinal axis of the cylinder chamber 28.

A second crankpin 90 of crankshaft 36 is received in the central portion 88 of tube 86 so that the longitudinal axis of crankpin 90 is perpendicular to the longitudinal axis of the central portion 88. A bearing 92 is provided between crankpin 90 and central portion 88. Crankpin 90 rotates within bearing 92 as piston assembly 32 reciprocates through the cylinder chamber 28 and lower piston chamber 33. Air passes through the central portion 88 around bearing 92 during operation of the engine 20.

In a manner similar to the upper cylinder chamber 26, an intake air/fuel mixture is drawn into the compression chamber 44 through inlets 85A and washer 85B in endwall 40B, passes through washer valve assembly 87, tube 86 and central portion 88, and exits in the combustion chamber. Exhaust ports carry away the exhaust gases.

Crankpin 60 extends through slots 112 and 113 of the top plate 110 and bottom plate 112, respectively, of the upper piston chamber 31. Crankpin 90 extends through slots 118 and 119 of the top plate 115 and bottom plate 116, respectively, of the lower piston chamber 33. Crank element 61, connected between crankpins 60 and 90, is freely movable in internal chamber 120.

A power transfer assembly 130 is provided at the top of the engine 20 to transfer rotary power from the crankshaft 36 to an output shaft 38. Crank element 132 is connected to the first crankpin 60 opposite crank element 61. A first roller 134 and a second roller 136 are mounted to crank element 132. A tangent bar 138 is journaled at one end to a flywheel 140 by pin 142. The tangent bar 138 includes an elongated slot 139 in its central portion for receiving rollers 134 and 136. The flywheel 140 is a conventional circular plate and includes a guide 144 on its lower surface for receiving tangent bar 138. The flywheel 140 can be integral with the output shaft 38 as illustrated in FIGS. 1 and 2. A cover 146 is constructed and arranged to protect the flywheel 140 and tangent bar 138. It is preferred that the cover 146 include a port 148 which aligns with exhaust port 74 in the upper cylinder chamber 26. The cover 146 includes a neck portion 150 for receiving the output shaft 38. A first bearing 152 and a second bearing 154 are provided between the neck portion 150 and the output shaft 38. The output shaft 38 is connected in any conventional manner to a load to provide a power source in a conventional manner.

It is desirable to provide an oil reservoir (not illustrated) beneath the lower piston chamber 33 between supports 24. A conventional oil pump (not illustrated) can be journaled to the lower end of crankpin 90. The reciprocating motion of piston assembly 32 transferred by crankpin 90 to an oil pump can deliver oil to the engine 20 as desired.

An exhaust pipe (not illustrated) can be fitted to port 148 and exhaust port 74 to transfer exhaust gases to a conventional muffler (not illustrated).

In operation, the engine 20 of FIG. 1 operates with two combustor pistons, namely piston heads 54 and 84. An intake air/fuel vapor is pressurized and explodes in combustion chambers 43 and 45, the respective piston assemblies 30 and 32 reciprocate and turn crankshaft 36. During operation the compound linear and circular movement of the piston assemblies 30 and 32 and the crankshaft 36 are transferred by the power transfer assembly 130 to the output shaft 38.

Figure 4A:
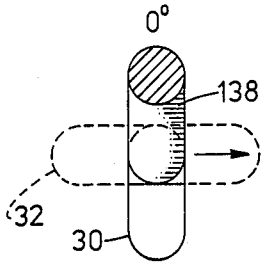
FIGS. 4A–4F are schematic views illustrating the rotation of a tangent bar during operation of the present engine.
Figure 4B:
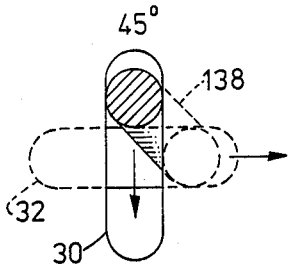
Figure 4C:
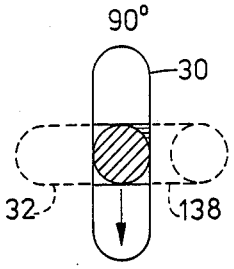
Figure 4D:
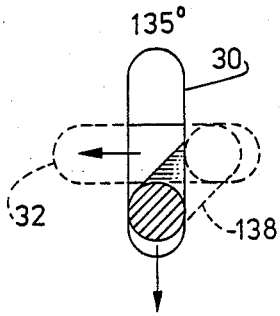
Figure 4E:
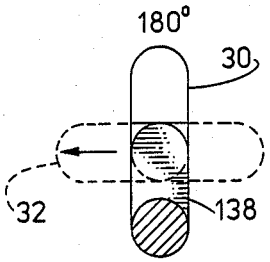
Figure 4F:
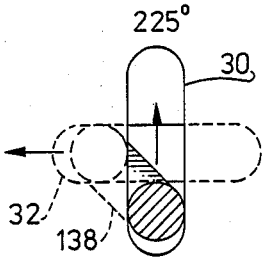

The schematic views 4A–4F illustrate the movement of the tangent bar 138. From 0° (FIG. 4A), the lower piston assembly 32 slides to the compression chamber 44 as illustrated in FIG. 4B), whereupon the sliding of the upper piston assembly 30 forces the tangent bar 138 to a 90° turn illustrated at FIG. 4C. As the upper piston assembly 30 reaches the compression chamber, the lower piston assembly 32 begins to travel to the combustion chamber 45(FIG. 4D) and causes the tangent bar 138 to travel 180° as illustrated at FIG. 4E. As the engine 20 continues to cycle, the tangent bar 138 will complete a full revolution and continue to rotate.

A second preferred embodiment of the present invention, indicated generally at 200, is illustrated in FIG. 2. All like elements of engine 200 are indicated with the same reference numeral as engine 20. Elements utilized in the second engine 200 only are indicated with reference numerals greater than 200.

Engine 200 is illustrated with an alternative support 224B for supporting the housing 22. Intake ports 65A of engine 20 are eliminated from endwall 240A, and intake ports 85A are eliminated from endwall 40B.

Figure 5:
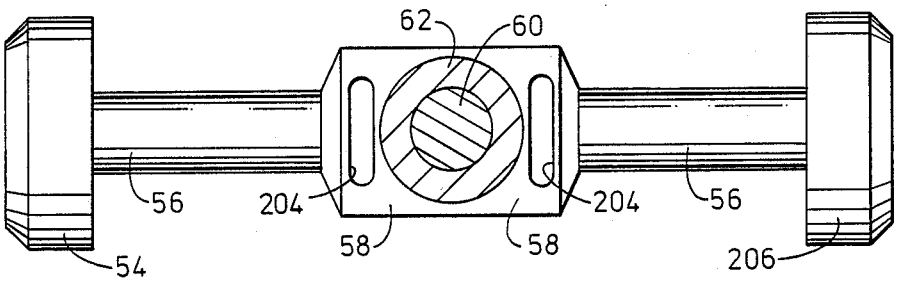
FIG. 5 is a side elevational view of an alternate piston assembly incorporated in the engine of FIG. 2.

An air inlet 202 is provided through the housing 22 and is in communication with internal chamber 120. A compressed air/fuel vapor is supplied to internal chamber 120 through inlet 202. As illustrated in FIG. 5, the central portions 58 and 88 of each piston assembly 30 and 32 include openings 204 on both sides of the respective crankpins 60 and 90. The air/fuel vapor passes through openings 204 and washer valve assemblies 264 and 68 provided in piston heads 52 and 54, respectively. It is preferred that compression piston heads 52 and 82 be replaced with a second combustion piston head 206, as illustrated in FIG. 5.

In operation, engine 200 is a four combustor internal combustion engine. Air/fuel mixture is compressed and produces explosions at all piston heads, thereby providing power to reciprocate piston assemblies 30 and 32 and crankshaft 36.

Advantages of the present invention include a reduced operating temperature. Furthermore, lubrication required for the engine of the present invention is minimal. High temperature cylinders can be utilized with the present engine so that pollutants will burn-up and not remain in the exhaust gases.

Although the present invention has been described with reference to preferred embodiments, workers skilled in the art will recognize that changes may be made in form and detail without departing from the spirit and scope of the invention.

What is claimed:

1. An internal combustion engine, comprising:

(a) a housing (b) a first cylinder chamber associated with the housing;

(c) a first piston assembly fitted in the first cylinder chamber, comprising a first piston head and a second piston head joined by a first tube, the first tube including a central portion;

(d) a first piston chamber constructed in the first cylinder chamber wherein the longitudinal axes of the first piston chamber and the first cylinder chamber are colinear, the first piston chamber bounded by a top plate, a bottom plate and side walls;

(e) a second cylinder chamber associated with the housing wherein the longitudinal axis of the second cylinder chamber is perpendicular to the longitudinal axis of the first cylinder chamber;

(f) a second piston assembly fitted in the second cylinder chamber, comprising a third piston head and a fourth piston head joined by a second tube, the second tube including a central portion;

(g) a second piston chamber constructed in the second cylinder chamber wherein the longitudinal axes of the second piston chamber and second cylinder chamber are colinear, the second piston chamber bounded by a top plate, a bottom plate and side walls;

(h) a crankshaft having first and second crankpins and first and second crank elements, wherein the first crankpin is journaled in the central portion of the first tube, the second crankpin is journaled in the central portion of the second tube, and the first crank element is freely rotatable in an internal chamber provided between the first and second piston chambers; and (i) a power transfer means for transferring the rotary motion of the crankshaft to an output shaft.

2. The internal combustion engine as specified in claim 1 including a vapor inlet in communication with the internal chamber for providing an air/fuel mixture to the first, second, third and fourth pistons.

3. An internal combustion engine, comprising:

(a) a housing;

(b) a first cylinder chamber connected to the housing, said first cylinder chamber having a longitudinal axis therethrough;

(c) a first piston assembly in said first cylinder chamber, said first piston assembly being reciprocably movable in said first cylinder chamber;

(d) a second cylinder chamber connected to the housing, said second cylinder chamber having a longitudinal axis therethrough oriented perpendicular to the longitudinal axis of said first cylinder chamber;

(e) a second piston assembly in said second cylinder chamber, said second piston assembly being reciprocably movable in said second cylinder chamber in timed relationship to the reciprocal movement of the first piston assembly;

(f) a crankshaft driven by the reciprocation of said first and second piston assemblies, said crankshaft further comprising:

(1) a first crankpin journaled to said first piston assembly about a first rotational axis, the first rotational axis being substantially perpendicular to the longitudinal axis of the first cylinder chamber and linearly movable as the first piston assembly reciprocates in the first cylinder chamber;

(2) a second crankpin journaled to said second piston assembly about a second rotational axis, the second rotational axis being substantially perpendicular to the longitudinal axis of the second cylinder chamber and linearly movable as the second piston assembly reciprocates in the second cylinder chamber; and (3) a first crank element connecting said first and second crankpins, said first and second crankpins being arranged so as to be in parallel but noncoincident planes, whereby the crankshaft operates in a compound linear and circular motion; and (g) a power transfer assembly for transferring the motion of the crankshaft to an output shaft.

4. The internal combustion engine as specified in claim 3 wherein:

(a) the first piston assembly comprises a first piston head and a second piston head joined by a first tube;

(b) the second piston assembly comprises a third piston head and a fourth piston head joined by a second tube;

(c) the first piston head includes valve means to permit gases to pass from the first cylinder chamber through the first tube to the second piston head; and (d) the third piston head includes valve means to permit gases to pass from the second cylinder chamber through the second tube to the fourth piston head.

5. The internal combustion engine as specified in claim 4 wherein:

(a) the second piston head includes valve means to prevent gases from passing from the first cylinder chamber into the first tube; and (b) the fourth piston head includes valve means to prevent gases from passing from the second cylinder chamber into the second tube.

6. The internal combustion engine as specified in claim 3 including an air inlet to supply gases to the first, second, third and fourth piston heads.

7. The internal combustion engine of claim 3, wherein the power transfer assembly comprises:

(a) a second crank element associated with said first crankpin parallel to said first crank element;

(b) roller means connected to said second crank element;

(c) a tangent bar having an elongated slot for receiving said roller means, said roller means being operative to transmit the rotation of the crankshaft to the tangent bar;

(d) a flywheel connected to said tangent bar and the output shaft, said flywheel being operative to transmit the rotation of the tangent bar to the output shaft.

8. The internal combustion engine of claim 7, wherein aid roller means comprises:

(a) a first roller connected to said second crank element, said first roller having a rotational axis which moves linearly within the elongated slot of said tangent bar as said first piston assembly reciprocates, and (b) a second roller connected to said second crank element, said second roller having a rotational axis that moves circularly about the rotational axis of said first roller as said first and second piston assemblies reciprocate, whereby the tangent bar revolves about its ends in an eccentric linear motion.

9. The internal combustion engine of claim 3, said housing including a first piston chamber colinear with the longitudinal axis of said first cylinder chamber and a second piston chamber perpendicular to the longitudinal axis of said first piston chamber and colinear with the longitudinal axis of said second cylinder chamber.

10. The internal combustion engine of claim 9, said first and second piston chambers being respectively disposed in first and second cylinder chambers for supporting the first and second piston assemblies distal to the piston heads.

11. An internal combustion engine, comprising:

(a) a housing;

(b) first and second cylinder chambers associated with the housing;

(c) first and second piston assemblies reciprocally disposed in said first and second cylinder chambers respectively, each of said piston assemblies including at least one piston head;

(d) a crankshaft having first and second crankpins, said first crankpin being interconnected to the first piston assembly for movement therewith and said second crankpin being interconnected to the second piston assembly for movement therewith; and (e) first and second piston chambers within said housing for respectively supporting the first and second piston assemblies distal to said piston heads as said first and second piston assemblies are reciprocally moved within said first and second cylinder chambers, said piston chambers being defined by at least one side wall within said housing and including an elongated slot in at least one of its respective side walls, the elongated slot in said first piston chamber receiving the first crankpin and the elongated slot in said second piston chamber receiving the second crankpin.

* * * * *